United States Patent [19]

Lovell

[11] 4,429,170

[45] Jan. 31, 1984

[54] PROCESS FOR REMOVING TAR BASES FROM LURGI TAR ACID STREAM

[75] Inventor: Robert L. Lovell, Pittsburgh, Pa.

[73] Assignee: Koppers Company, Inc., Pittsburgh, Pa.

[21] Appl. No.: 398,068

[22] Filed: Jul. 14, 1982

[51] Int. Cl.[3] ..... C07C 37/74; C07C 37/68

[52] U.S. Cl. ..... 568/761; 568/749; 568/759

[58] Field of Search ..... 568/761, 749, 759

[56] References Cited

U.S. PATENT DOCUMENTS 2,298,816 10/1942 Ambler ..... 568/761
2,301,270 11/1942 Gerlicher ..... 568/761

OTHER PUBLICATIONS

Fisher et al., "Bureau of Mines Report, Dept. of Interior Extraction Methods for Determining Tar Acids and Bases, and Variable Affecting their Accuracy" dated 1937, 5303, pp. 1–34.

*Primary Examiner*—Werren B. Lone
*Attorney, Agent, or Firm*—Daniel J. Long; Herbert J. Zeh, Jr.

[57] ABSTRACT

A process is disclosed for purifying the tar acid mixture that is obtained from the Lurgi process of coal gasification. The tar acid is treated with dilute aqueous sulfuric acid solution to form non-volatile tar base salts from the tar base component and to hydrolyze the neutral oil component and then distilling the tar acid component off from the non-volatile tar base salts and the hydrolysis products of the neutral oil component.

3 Claims, No Drawings

PROCESS FOR REMOVING TAR BASES FROM LURGI TAR ACID STREAM

CROSS-REFERENCE TO RELATED APPLICATION

The invention described in application Ser. No. 398,074 filed on even date with Nicholas P. Greco listed as inventor is related in that both applications are assigned to the same assignee and both involve the purification of Lurgi tar acids by separation into the tar base and neutral oil components.

BACKGROUND OF THE INVENTION

1. Field of the Invention

This invention relates generally to tar acid and more particularly to the reduction of the inherent impurity constituents in tar acids.

2. Prior Practice

Crude tars contain tar acids, tar bases, and neutral oils. These are commercially valuable substances. The crude tar is subjective to distillation to remove these compounds and change the characteristics of the tar. Unfortunately, the boiling point of the various ingredients of the crude tar tend to overlap and therefore the specific ingredients are not readily separated by distillation of the tar. Accordingly, the tar is first subjective to distillation that gives cuts encompassing a wide range of temperatures.

The first distillate fraction is that which distills from tar at temperatures below 230°-240° C. is generally referred to as "tar acids" and is mainly comprised of hydroxy benzenes such as phenols and homologues. This distillate may then be separated either by chemical means or by physical means such as fractional distillation into comparatively pure components, usually as phenol, ortho cresol, meta and para cresol and the six isomers of xylenols. Usually the distllate fraction also include some "tar bases" which are mainly cyclic, nitrogen containing compounds such as pyridine, picoline, lutidine, collidine, aniline, toluidine, xylidine, quinoline, isoquinoline and quinaldine. The distillate fraction may also include some "neutral oil" which is comprised of hydrocarbon derivatives of benzene and naphthalene. As may be expected, the composition of a cut depends upon the tar from which the cut is obtained.

The main source of tar acids has heretofore been the tar that is obtained as the by-product of the coking of coal. The tar acids fraction obtained by the distillation of this tar is about 10–20% of the crude coal tar.

Recently a source of tar acids has become available from the Lurgi gasification process. The Lurgi process uses oxygen and steam to gasify brown coal, lignite and non coking sub-bituminous coals in a fixed bed at pressures of 20 to 20 atmospheres and produce a fuel gas. The crude gas leaving the gasifier contains carbonization products such as tar, oil, naphtha, phenols, cyanides, and coal and ash dusts. The gas is cleaned, i.e., these products are removed from the gas before the gas is used as a fuel. The tar that is thus obtained is subjected to distillation in the same manner as in the tar obtained from the production of coke to obtain various distillation cuts.

Tar acids are valuable commercially in the production of numerous items such as resins, plasticizers, and disinfectants. The boiling points of the tar acids, tar bases and neutral oil are such that they cannot be effectively separated by distillation alone. The contamination of the tar acids by the tar bases and neutral oils impair the utility of the tar acids.

The tar acid distillate cut from the by-product tar from the Lurgi process and popularly termed "Lurgi tar acids" has a composition typically comprising 93% tar acids, 5% tar base and 2% neutral oil.

SUMMARY OF THE INVENTION

This invention provides a process for purifying a tar acid mixture obtained as a by-product of coal gasification from the tar base and neutral oil contaminates. In the process, according to the invention, the tar acid mixture is treated with a water-diluted sulfuric acid solution at a temperature of about 80° C. to 120° C. to convert the tar bases to non-volatile tar base salts and to form hydrolysis products of the neutral oil component and then the tar acids are distilled from the non-volatile tar base salts and the hydrolysis products.

DETAILED DESCRIPTION OF THE INVENTION

The tar acid derived from the tar that is the by-product of coal gasification process contains about 93% of the desired tar acid components such as phenols, cresols, and xylenol and about 7% of the undesirable products, the tar bases such as aniline, pyridine and quinoline and the neutral oils such as nitriles alkylbenzene, naphthalene and thio-aromatic compounds. The process of this invention can reduce the tar base for example from a 5% content to a 0.1% or less content, a fifty fold decrease in contaminants.

In accordance with this invention, a dilute sulfuric acid solution is mixed with the crude tar acid distillate that contains the tar bases and neutral oils as contaminants or impurities. The mixture is maintained at a temperature of 80° C. to 120° C. for a period of time to convert the tar base component to non-volatile tar base salts and to form hydrolysis products of the neutral oil component. The sulfuric acid is an aqueous solution containing about 10–25 weight percent of sulfuric acid. About one and one half times the amount of sulfuric acid is used that would be stoichiometrically required to react with the tar base component.

This combination of a slight excess of weak sulfuric acid solution and low temperature converts the tar bases to non-volatile sulfuric acid complexes while minimizing or substantially avoiding the sulfonation of the hydroxy benzenes. At the same time the sulfuric acid reacts with the neutral oil component. As an example, benzonitrile which may constitute 40% of the neutral oil is hydrolyzed to benzoic acid.

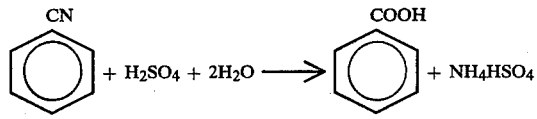

Thus the process has the advantage of the simultaneous changing of the volatility of the tar base and neutral oil component in this single step. Thereafter, the volatile tar acids are distilled from the sulfuric acid complexes and the hydrolysis products. The refined tar acids are the distillate and the impurities the residue.

The commercially valuable tar acids have boiling ranges of about 180° to 300° C. at atmospheric pressure; but, those tar acids boiling below 240° C. have the greatest commercial value. It is preferred that the tar acids be separated by continuous vacuum flash distillation, for example at 120° C. and 20 mm mercury pressure absolute (equivalent to 245° C. at atmospheric pressure). Carrying out the distillation at this low temperature tends to prevent decomposition of the tar base complexes. The high boiling tar acid which are not desired remain with the residue.

As a practical illustration of the invention, a Lurgi tar acid was analyzed and found to contain by weight 93.2% tar acids, 5.3% tar bases and 1.5% neutral oils. This Lurgi tar acid (3,000 parts by weight) was mixed with 490 parts by weight of an aqueous solution containing 25% $H_2SO_4$ by weight (50% molar excess based on the analyzed tar base content) solution. The mixture was maintained at 102° C. (reflux) for 0.5 hours in a container equipped with a stirrer and reflux condenser.

After this treatment, the mixture was then fed continuously to a 2" diameter column equipped with a low residence time thermosiphon reboiler maintained at 119° C. and 23 torr pressure. Distillate oil flashed overhead and was collected in a water-cooled condenser and receiver. Most of the water in the charge was recovered in a cold trap upstream of the vacuum source. A viscous black residue was continuously removed from the flash chamber.

The distillate oil was analyzed and found by weight to consist of 6.4% $H_2O$, 1.3% neutral oil, 0.01% $N_2$, and 92.2% tar acids (by difference). The yield of tar acids in the distillate oil by weight based on the original change of Lurgi tar acid was 86%.

The foregoing has presented a novel process for isolating a tar acid fraction, particularly the tar acid fraction that is derived from the tarry by-product of the Lurgi coal gasification process to enable the tar acids to meet the commercially acceptable standards.

What is claimed:

1. A process for purifying a tar acid mixture that is obtained as by-product of coal gasification by the Lurgi process and that contains tar base and neutral oil components as contaminants, comprising:

(a) treating the tar acid mixture with an amount of dilute aqueous sulfuric acid solution having a range from about 10 to about 25 concentration by weight percent of $H_2SO_4$ in an amount of at least about fifty percent stoichiometric excess of the amount of tar base component initially present in the tar acid mixture, at a temperature in a range from about 80° C. to about 120° C., for sufficient time to form non-volatile tar base salts from the tar base component and to form hydrolysis products of the neutral oil component; and then (b) separating the non-volatile tar base salts and the hydrolysis products from the tar acid mixture by distillation.

2. The process of claim 1 wherein the treating is carried out under reflux conditions at atmospheric pressure.

3. The process of claim 1 wherein the distillation is carried out as a continuous vacuum distillation.

* * * * *